US006523869B1

(12) United States Patent
Jensen et al.

(10) Patent No.: US 6,523,869 B1
(45) Date of Patent: Feb. 25, 2003

(54) AUTOMOBILE RELEASABLE LOCKING LATCH ASSEMBLY

(75) Inventors: Thomas Charles Jensen, Clarkston, MI (US); David K Rock, Washington, MI (US); Leon S. Kayser, West Bloomfield, MI (US); James Turner, Clinton Township, MI (US); Eric L. Swander, Lake Orion, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/976,926

(22) Filed: Oct. 15, 2001

(51) Int. Cl.[7] ..... E05B 3/00

(52) U.S. Cl. ..... 292/336.3; 292/216; 292/DIG. 29; 292/DIG. 43; 70/208; 70/209

(58) Field of Search ..... 292/336.3, 216, 292/DIG. 23, DIG. 29, DIG. 42, DIG. 43; 70/208, 209, 237, 258, 264, 275, 416

(56) References Cited

U.S. PATENT DOCUMENTS 4,143,904 A * 3/1979 Cooper et al. ..... 292/DIG. 29
5,303,971 A * 4/1994 Johnsen et al. ..... 292/DIG. 2
5,987,943 A 11/1999 Verga et al. ..... 70/208
6,168,216 B1 * 1/2001 Nakajima et al. ..... 292/201
6,192,725 B1 * 2/2001 Watson et al. ..... 292/336.3
6,209,366 B1 * 4/2001 Zagoroff ..... 292/DIG. 3
6,240,754 B1 * 6/2001 Petersen ..... 292/346
6,264,257 B1 * 7/2001 Meinke ..... 292/336.3
6,318,135 B1 * 11/2001 Johnsen et al. ..... 292/DIG. 31
6,406,075 B1 * 6/2002 Rice et al. ..... 292/336.3

FOREIGN PATENT DOCUMENTS

JP 59-9724 * 1/1984

* cited by examiner

*Primary Examiner*—Robert J. Sandy
*Assistant Examiner*—Andre L. Jackson
(74) *Attorney, Agent, or Firm*—Laura C. Hargitt

(57) ABSTRACT

A releasable locking latch assembly for an endgate of a pickup truck, which includes a handle for rotating the mechanisms of the locking latch assembly resulting in the retraction of one or more cables further resulting in the release of an endgate. The locking latch assembly includes a locking finger for impeding the movement of the locking latch assembly in a locked position and a lock for rotatably engaging the locking finger into and out of the locked position.

6 Claims, 6 Drawing Sheets

AUTOMOBILE RELEASABLE LOCKING LATCH ASSEMBLY

TECHNICAL FIELD

This invention relates generally to a releasable locking latch for a vehicle. In particular, this invention relates to a releasable locking latch that includes a barrier surrounding the internal mechanical components comprising the locking latch assembly and internal components that reduce the amount of movement in the latching handle once the locking latch assembly is locked.

BACKGROUND OF THE INVENTION

It is well known in the automotive industry that pickup trucks are becoming a primary means of transportation. Likewise, it is also typical for these vehicles to be used to transport and/or store items such as groceries, department store purchases, building supplies, tools, personal items and the like. Often, items transported in pickup trucks are stored in the truck bed or cargo area.

Pickup trucks typically have covers or integrated tops to enclose items located in the truck bed during transportation. When these covers or integrated tops are used in conjunction with endgates, rear doors or the like, it may be desirable to secure items stored in the pickup truck bed behind a lockable endgate assembly. Although lockable endgate assemblies exist, it may be desirable to provide an improved locking latch assembly that provides a barrier around the internal components comprising the locking features of the locking latch assembly and internal mechanical components that limit the amount of movement in the latching handle once the locking latch assembly is locked.

SUMMARY OF THE INVENTION

The present invention relates to a releasable locking latch assembly for a vehicle endgate. The latch assembly includes a handle for rotating the internal components of the locking latch assembly causing one or more cables to retract resulting in the opening of a vehicle endgate. The locking latch assembly further includes a locking finger for impeding movement of the internal components of the locking latch assembly in a locked position and a lock for rotatably engaging the locking finger into and out of the locked position. In a preferred embodiment the latch assembly also includes a shield mounted to the vehicle endgate and to the locking latch assembly, wherein the shield substantially covers the locking latch assembly.

DESCRIPTION OF THE PREFERRED EMBODIMENT

Figure 1:
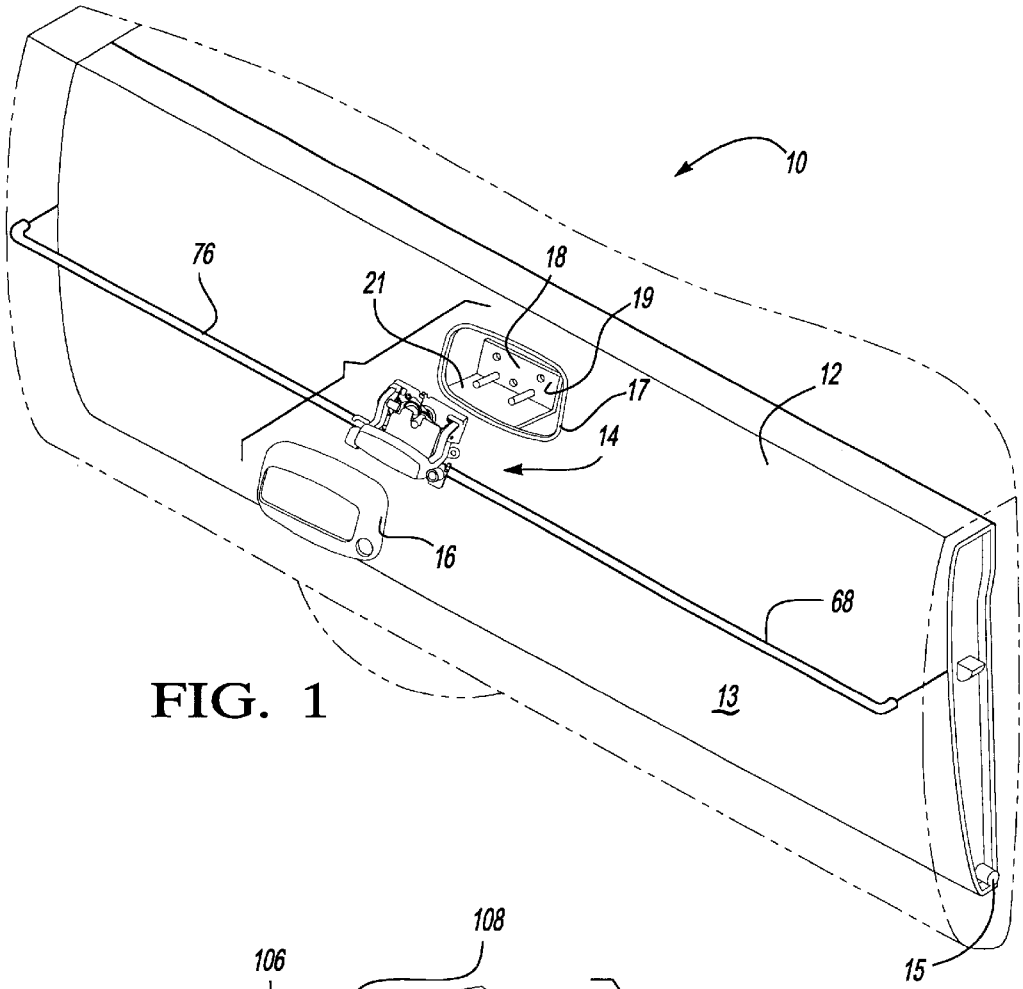
FIG. 1 is an exploded perspective view of an automotive endgate and a releasable locking latch assembly in accordance of the present invention.

Referring to FIG. 1, a releasable locking endgate assembly 10 is illustrated for use in, but not restricted to, an automotive endgate 12 and includes a releasable locking latch assembly 14 and bezel 16. As best seen in FIG. 1, the endgate 12 is typical of a pick-up truck endgate and such endgates are well known in the industry and would be apparent to one skilled in the art; thus a detailed description of the endgate's mechanics is not shown in FIG. 1.

The endgate 12 includes a substantially planar panel 13 and hinge points 15, wherein the hinge points 15 are located on opposing sidewall surfaces of the panel 13. In accordance with techniques known in the industry, the hinge points 15 are coupled to the body of an automobile (shown in phantom), and the panel 13 is allowed to pivot rotate about the hinge points 15.

Figure 3:
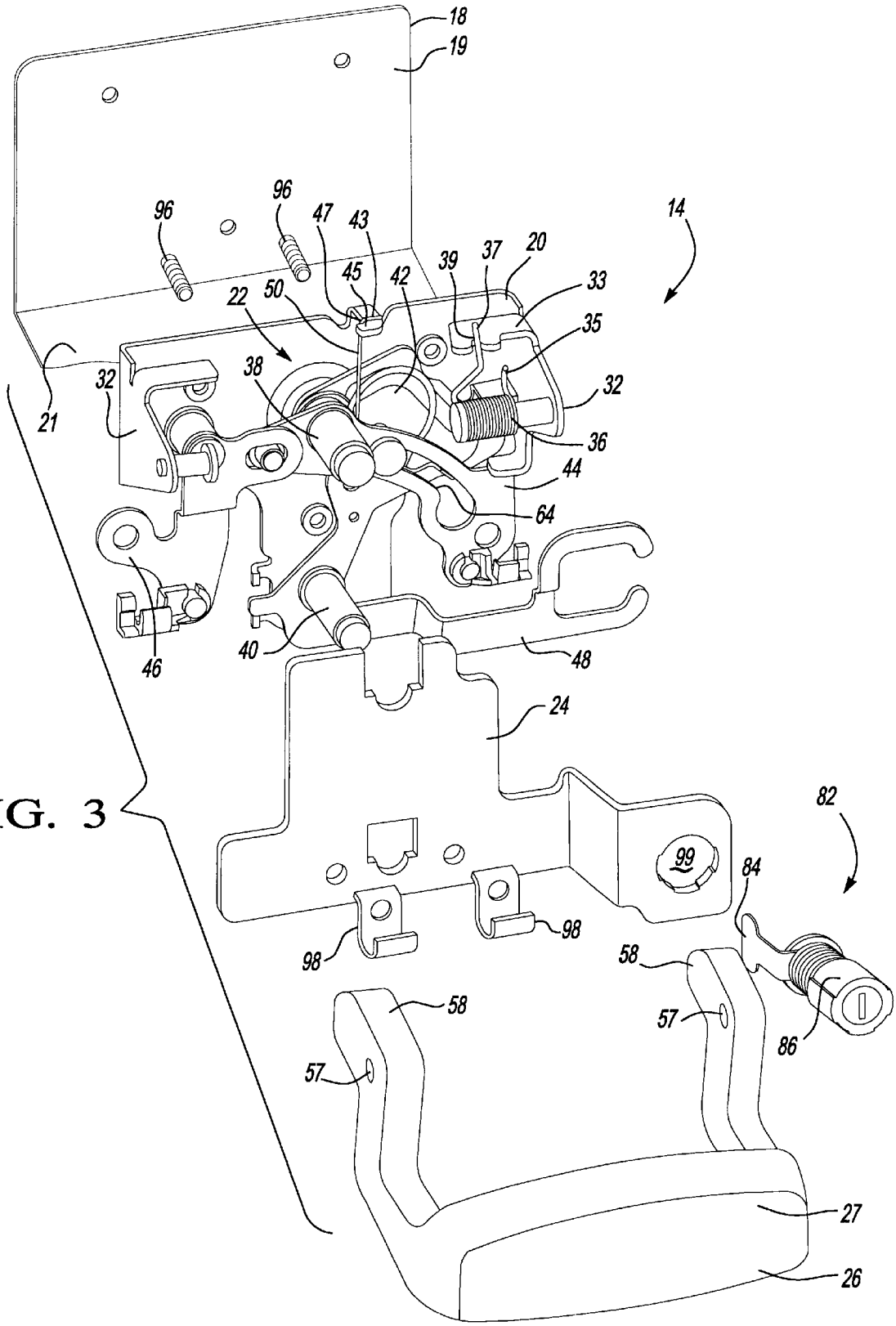
FIG. 3 is an expanded perspective view of a releasable locking latch assembly of the present invention.

The endgate 12 also includes an opening 17 for receiving a supporting surface such as a mounting bracket 18. As best seen in FIG. 3, the mounting bracket 18 includes a first arm 19 and a second arm 21, both having separate, substantially planar mounting surfaces. The second arm 21 is angularly positioned with respect to the first arm 19. More particularly, the second arm may be positioned at ninety degrees (90° ) relative to the first arm 19. The first arm 19 is attached to the planar panel 13 of the endgate 12 via threaded fasteners such as screws or bolts now shown. However, it will be appreciated that the mounting bracket 18 could be attached to the endgate 12 using other methods known in the industry, such as welding or other similar techniques.

Figure 2:
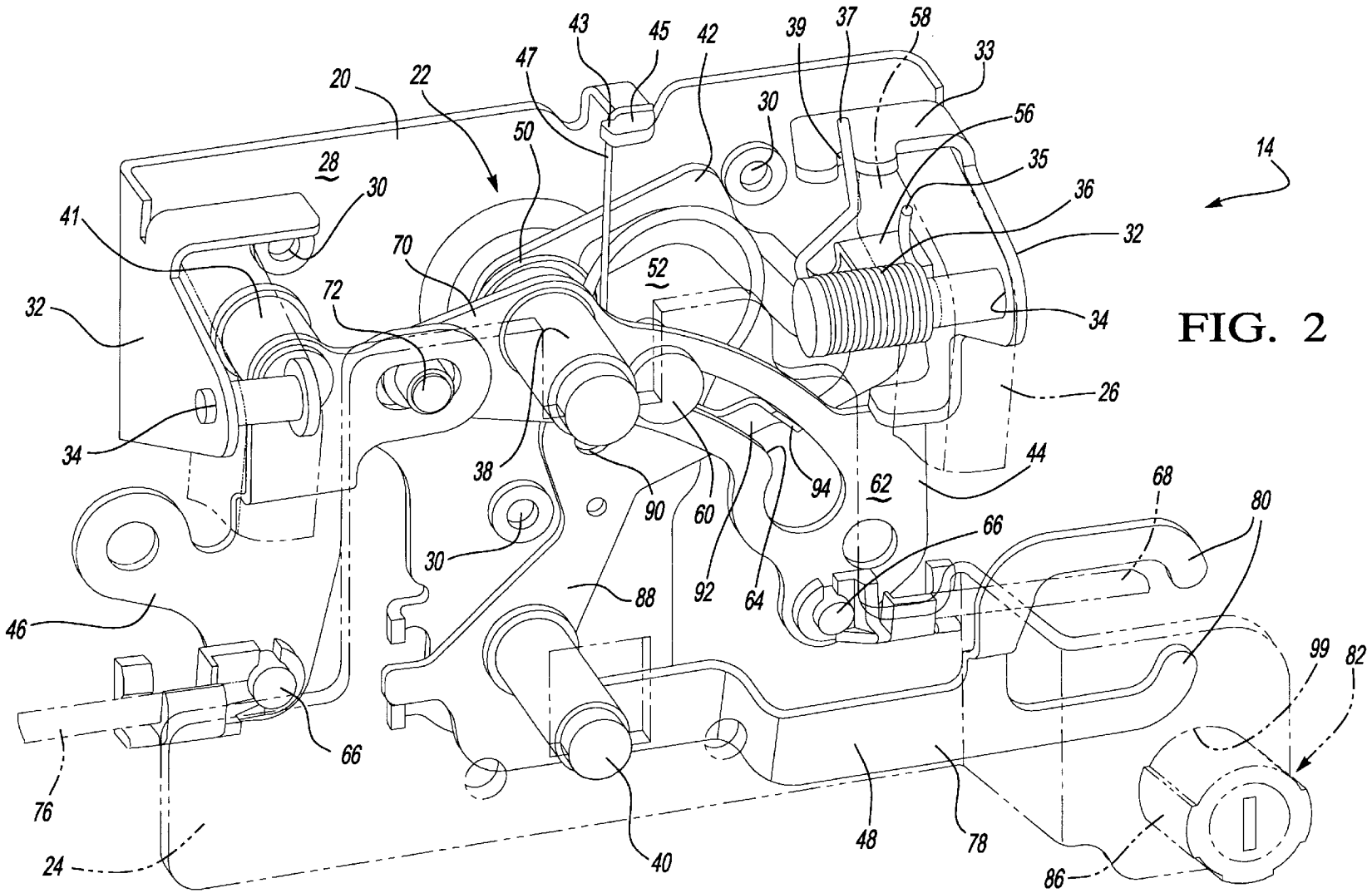
FIG. 2 is a perspective view of the releasable locking latch assembly in accordance of the present invention.

Turning now to a discussion of the locking latch assembly 14, as best shown in FIGS. 2 and 3, the locking latch assembly 14 includes a locking latch bracket 20; internal mechanical components 22 that may comprise, but are not limited to, a latch arm 42, a drive lever 44, a slave lever 46 and a lock lever 48; a shield 24 and a door handle 26. As best seen in FIG. 2, the locking latch bracket 20 supports the internal mechanical components 22, the shield 24 and the handle 26.

In a preferred embodiment, the locking latch bracket 20 includes a substantially flat surface 28, as best seen in FIG. 2. The flat surface 28 includes a plurality of holes 30 for mounting to the mounting bracket 18 using threaded or unthreaded fasteners (not shown).

Additionally, the locking latch bracket 20 may include projecting arms 32 that are substantially perpendicular to the flat surface 28 of the locking latch bracket 20. These projecting arms 32 may be substantially flat and each defining a hole 34 that allows for the pivotal mounting of an automobile door handle 26.

Figure 4:
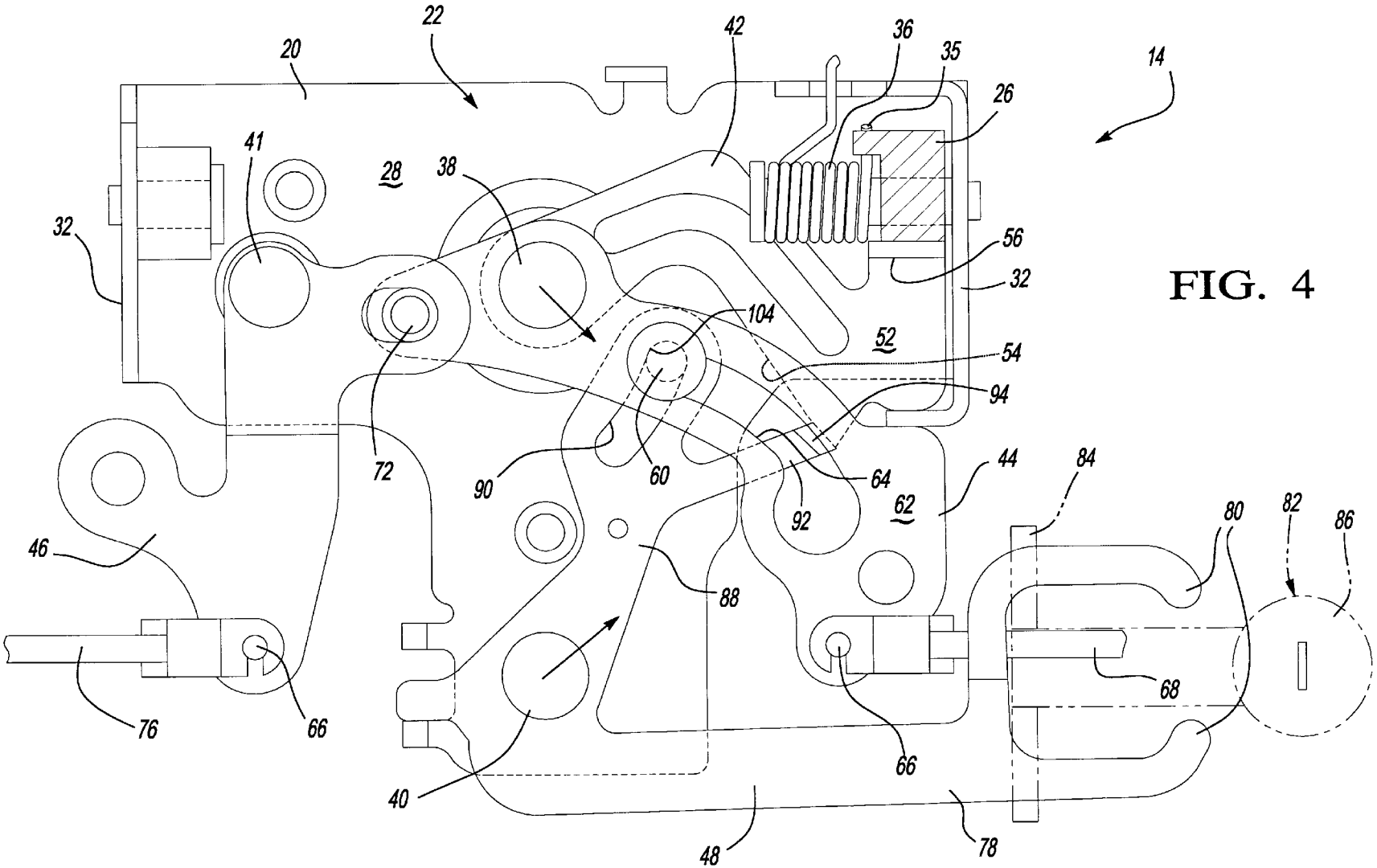
FIG. 4 is a front elevational view of a releasable locking latch assembly of the present invention.

As best seen in FIG. 3, the door handle 26 is of the type typically used in the industry, and includes a substantially flat gripping surface 27 positioned between outwardly projecting parallel extending arms 58. As best seen in FIG. 4, the handle 26 is rotationally biased by spring 36, wherein spring 36 exerts a force on the handle 26, causing the handle 26 to return to the original unlifted position upon release.

The spring 36 is mounted on a spool received in an opening defined by the mounting bracket 18. One end 35 of the spring 36 is coupled to the handle 26. The opposite end 37 of the spring 36 is supported by a second projecting arm 33, wherein the projecting arm 32 closest to the handle 26 supports the second projecting arm 33, as best seen in FIG. 2. As shown in FIG. 2, the second projecting arm 33 includes a slot 39 that receives the opposite end portion 37 of the spring 36.

The bracket 20 also includes a third projecting arm 43 that extends outwardly from the flat surface 28. The third projecting arm 43 includes a hooked shaped end 45 that receives and supports an end 47 of a second spring 50. As best seen in FIG. 2 and explained in more detail below, the spring 50 is a coil spring supported by a primary pivot pin 38 and biases movement of latch arm 42 by an opposing force created by the projecting arm 43 transmitted through spring 50 to the latch arm 42.

As best seen in FIG. 2, the locking latch bracket 20 also supports a plurality of pivot pins extending outwardly from the flat surface 28, wherein the pivot pins allow the internal mechanical components 22 to be rotatably mounted. While many combinations can exist with different locking latch assemblies, in a preferred embodiment the primary pivot pin 38, a secondary pivot pin 40 and a slave arm pivot pin 41 are used for mounting of the internal mechanical components 22.

For instance, the latch arm 42 is rotatably mounted to the primary pivot pin 38 and biased by spring 50. Latch arm 42 is configured to receive a load from the extending arm 58 of handle 26 and transmit at least a portion of said load to drive pin 60. Latch arm 42 includes a substantially flat surface 52 with an interior contact surface 54 and a latch arm projection 56. The latch arm projection 56 is substantially perpendicular to flat surface 52 and configured to receive a force from the cammed surface of extending arms 58 of handle 26. This force results in the rotation of latch arm 42, causing interior surface 54 to rotate and resulting in an applied force from the interior surface 54 to drive pin 60 in a specific mode of operation. Upon release of the handle 26 and reduction of the load to latch arm 42, the latch arm 42 returns to its original position through the biasing tension of spring 50.

As best shown in FIG. 2, also mounted to primary pivot pin 38 is the drive lever 44. Drive lever 44 is configured to receive a portion of the load transmitted through drive pin 60, resulting in the rotation of drive lever 44 further resulting in the retraction of first cable 68. Preferably, the drive lever 44 is separated from latch arm 42 with a suitable separator such as a washer.

A first arm 62 of the drive lever 44 is configured with a first slot 64 which receives drive pin 60. The width of the first slot 64 is configured such that the drive pin 60 moves along the slot with a minimal amount of play and surface friction. First arm 62 of the drive lever 44 further consists of a cable pin 66 for mounting a first cable 68 for the release of one or more latch mechanisms typically associated with an endgate 12.

In a preferred embodiment, the drive lever 44 is configured with a second arm 70 having a protruding slave pin 72 for rotating a slave lever 46. The slave lever 46 is rotatably mounted to slave arm pivot pin 41 and moves in a counter direction to drive lever 44, causing a second cable 76 to retract causing one or more latch mechanisms to release from endgate 12.

Figure 5:
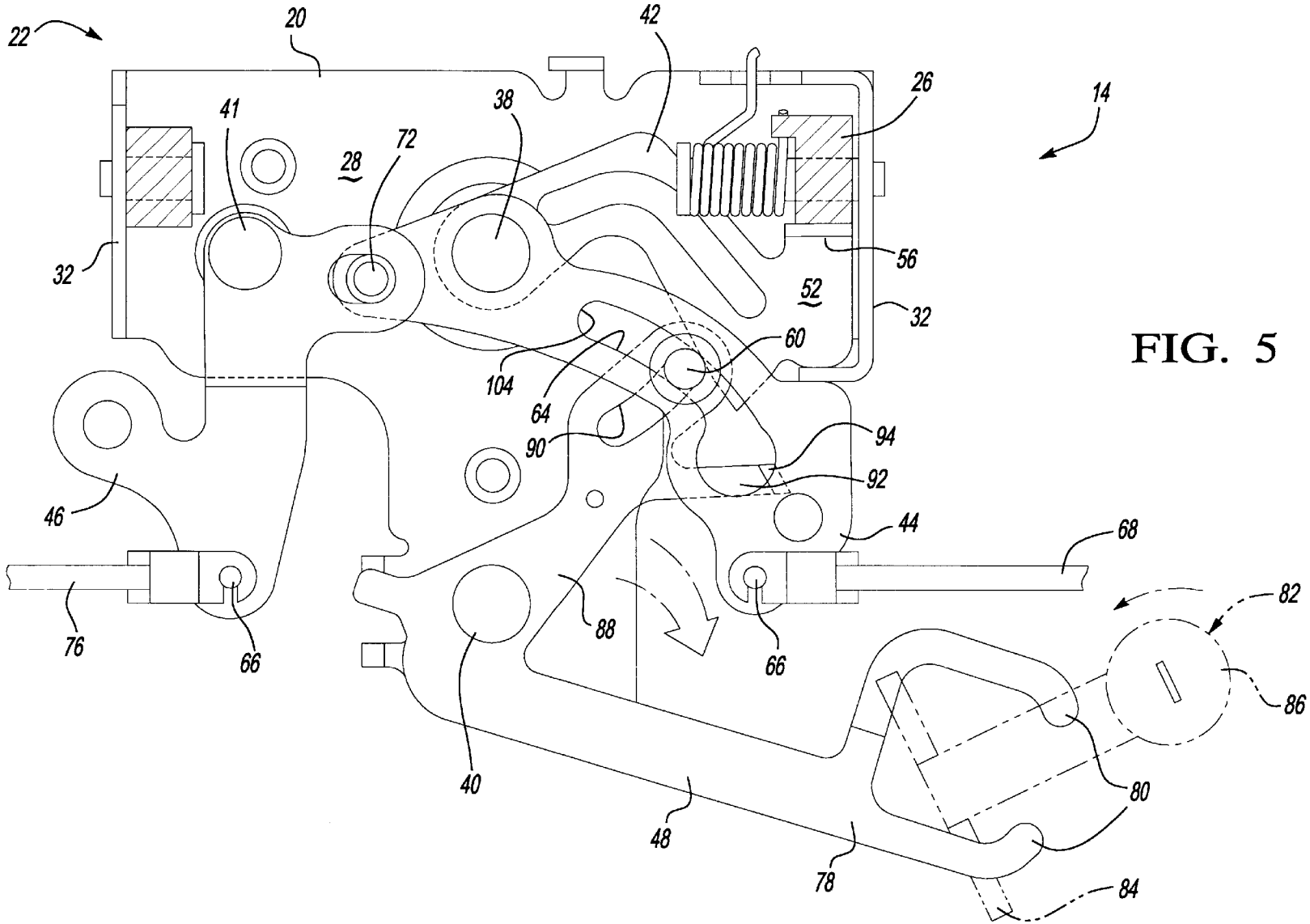
FIG. 5 is another front elevational view of a releasable locking latch assembly of the present invention.
Figure 6:
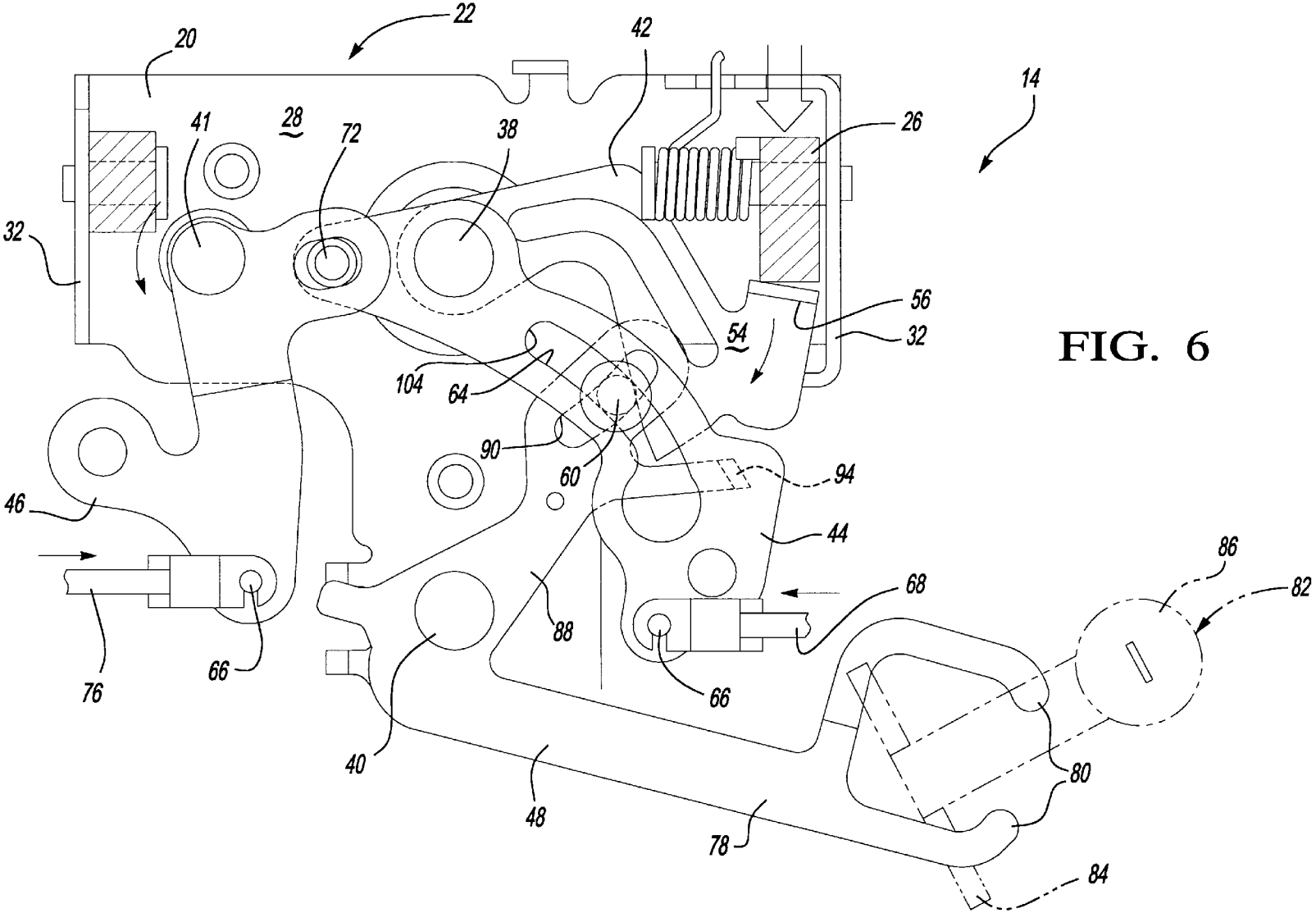
FIG. 6 is yet another front elevational view of a releasable locking latch assembly of the present invention.

Referring now to FIGS. 4–6 and a discussion of the lock lever 48, the lock lever 48 is configured to impede the rotation of latch lever 42 in a first position and remain substantially unobstructed to the latch lever 42 in a second position. As best seen in FIG. 4, the lock lever 48 is rotatably mounted to secondary pivot pin 40 and located between the mounting bracket 20 and latch arm 42.

Lock lever 48 has a first arm 78 with fingers 80 for engaging with a lock assembly 82. The lock assembly 82 is also configured with a locking pawl 84 for engaging with the fingers 80 of the lock lever 48 and a tumble lock 86 for rotating the locking pawl 84. Additionally, lock lever 48 includes a second arm 88 configured with a second slot 90 which also receives and partially supports drive pin 60. The width of the slot 90 is configured such that the drive pin 60 moves along the slot 90 with a minimal amount of play and surface friction.

Projecting from the second arm 88 of the lock lever 48 is a finger 92 for impeding the rotation of the latch arm 42 when the locking latch assembly 14 is in the locked position. The finger 92 includes an extending member 94 which substantially protrudes into the rotatable area of the latch arm 42, wherein the extending member 94 projects perpendicularly away from the substantially flat surface of the lock lever 48. Additionally, extending member 94 of finger 92 is positioned such that at least a portion of extending member 94 is on the same planer level as the substantially flat surface 52 of latch arm 42. In a particular mode of operation, the extending member 94 of the finger 92 obstructs the rotational movement of the latch arm 42.

As illustrated in FIG. 2 (in phantom) and FIG. 3, a shield 24 may be incorporated with the locking latch assembly 14 of the present invention. The shield 24 may be incorporated with the locking latch assembly of the present invention to provide a barrier around the internal mechanical components 22, wherein the internal mechanical components 22 cooperate to reduce or substantially limit the movement of the handle 26. In a preferred embodiment, the shield 24 may be manufactured from a material resistant to deformation or shearing such as metal or reinforced plastics.

In a preferred method of mounting, shield 24 is mounted first about the primary pivot pin 38 and the secondary pivot pin 40 of the locking latch assembly. In a more preferred method of mounting, shield 24 is additionally mounted to the mounting bracket 18 using fasteners known in the art such as threaded fasteners 96 and j-nuts 98.

Additionally, the shield 24 optimally has an extended part defining a hole 99 for receiving and securing a locking device such as a tumble lock 86. Such a configuration can be observed and described in U.S. Pat. No. 5,987,943 as issued to Verga et al., which patent is owned by the assignee of the present invention and is incorporated herein by reference.

Turning to a general discussion of the operation of the locking latch assembly 14, in a preferred embodiment, the tumble lock 86 is used to manipulate the position of the lock lever 44. In a first mode of operation the lock lever 44 is in the unlocked position and the internal mechanical components 22 are allowed to rotate or pivot relative to one another. In a second mode of operation the lock lever 44 and tumble lock 86 are in the locked position, thus, substantially preventing movement of the internal mechanical components 22.

More specifically, in a first mode of operation, the locking latch assembly 14 is unlocked, as illustrated by FIGS. 5 and 6, wherein the locking pawl 84 is rotatably depressed resulting in lock lever 48 also being rotatably depressed. As the lock lever 48 rotates, the lock lever finger 92 and the extending member 94 rotate allowing the latch arm 42 to rotate about the primary pivot pin 38.

More specifically and referring to FIG. 6, as handle 26 is rotatably lifted, the latch arm projection 56 is depressed by one of the extending arms 58, causing the latch arm 42 to rotate about the primary pivot pin 38. This action causes the interior surface 54 of the latch arm 42 to come in contact with the drive pin 60, wherein the drive pin 60 is slidably attached to the second slot 90 of the lock lever 48 and a first slot 64 of the drive arm 44. As the latch arm 42 continually rotates, the drive pin 60 slides along second slot 90 of the lock lever 48, causing the drive arm 44 to rotate about the primary pivot pin 38 due to the force transmitted through drive pin 60 by first slot 64. Additionally, the drive arm 44 is configured with a slave pin 72, which is slidably coupled to a slave arm 46, and a cable pin 66 coupled to a first cable 68.

The slave arm 46 is pivotally mounted to the slave arm pivot pin 41 and rotates counter to the drive arm 44. The slave arm 46 also has a cable pin 66, which is coupled to a second cable 76. As the drive arm 44 rotates, both the first and second cables 68, 76 are partially retracted toward the center of the locking latch assembly 14, allowing the endgate 12 to be opened. Upon releasing the handle 26, spring 50 and spring 36 return the internal mechanical components 22 and handle 26 to their original positions.

In a second mode of operation, the locking latch assembly 14 and tumble lock 86 are in the locked position, as illustrated by FIG. 4. In this mode, the tumble lock 86 and locking pawl 84 are substantially horizontal, thus preventing fingers 80 and lock lever 48 from rotating clockwise into the first mode or unlocked position. This arrangement results in extending member 94 of lock lever 48 residing substantially in the travel path of the drive arm 44. In this position, the extending member 94 obstructs the movement of the interior contact surface 54 of the latch lever 42, thus preventing the movement of the latch lever 42.

For example, as the handle 26 is lifted, a force is rotatably created by one of the extending arms 58 on to the latch arm projection 56 and latch arm 42. With the lock lever 48 in the locked position and extending member 94 extending into the travel path of the drive arm 44, a reactant force is applied to the interior contact surface 54 by the extending member 94 of finger 92 substantially preventing motion of latch arm 42.

In a preferred system, the force created by the extending member 94 would be equal to that of the applied force to the handle 26. In a most preferred system, the force created by the lock finger 92 would be greater than the maximum strength of the extending arm 58 of the handle 26. This lack of rotation of the internal mechanical components 22 prevents the first and second cables 68, 76 from being retracted and further prevents the endgate 12 from opening.

SECOND EMBODIMENT OF THE PRESENT INVENTION

Figure 7:
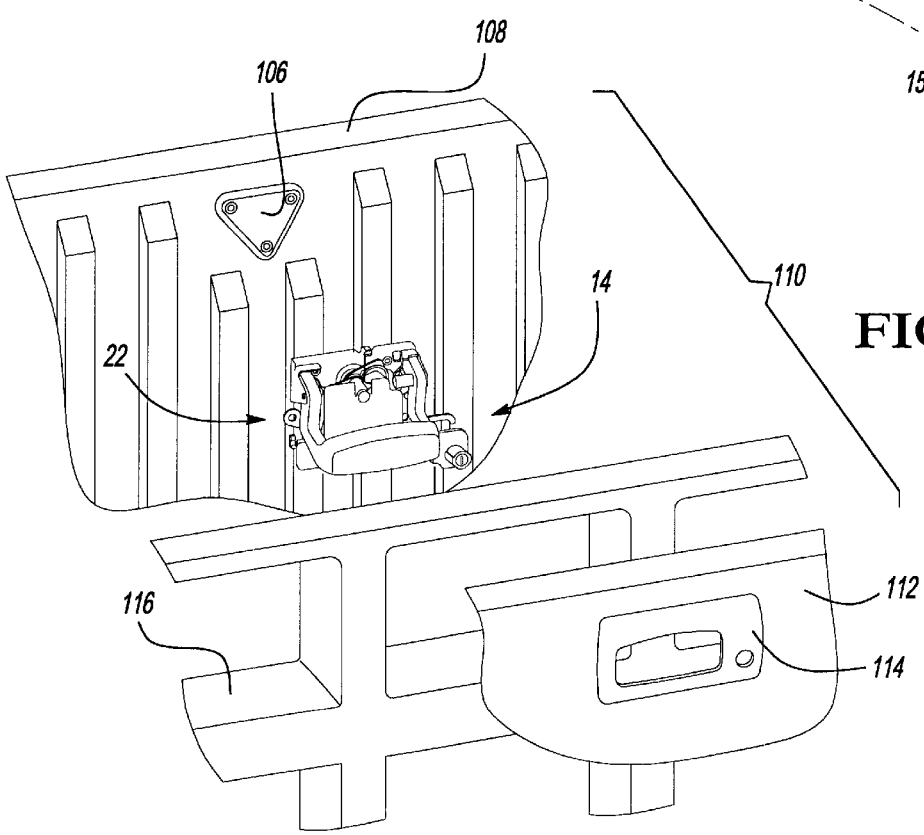
FIG. 7 is an expanded perspective view of an alternate endgate and releasable locking latch assembly in accordance of the present invention.

In a second embodiment, as illustrated in FIG. 7, the locking latch assembly 14 is mounted to a substantially flat surface 106 of an interior panel 108 of a composite endgate 110. An outer shell 112 is then attached to the interior panel 108, through methods know in the arts such as adhesives or pushpins, such that an integrated bezel 114 would cover a portion of the internal mechanical components 22 of the locking latch assembly 14. Preferably, a reinforcing member 116 may be incorporated to add structural integrity to the composite endgate 110.

It is foreseeable that the present latch assembly may be incorporated in various endgates with materials or combination of materials that have less resistance to any deformation or destruction than a more typical metallic based endgate. While this first example utilizes a pickup truck endgate, it is foreseeable that any number of vehicles comprising of an endgate may be utilized. Some examples of automotive endgates may included vans, pickup trucks, sport utility vehicles, station wagons or there like. It is further foreseeable that these endgates are pivotally mounted and open in various directions such as pivotally raised, lowered, and swing outboard and may even be comprised of a combination of two or more doors or panels.

The foregoing detailed description provides preferred exemplary embodiments only, and is not intended to limit the scope, applicability, or configuration of the invention in any way. It being understood that various changes may be made in the function and arrangement of elements described in an exemplary preferred embodiment without departing from the spirit and scope of the invention as set forth in the appended claims.

What is claimed is:

1. A releasable locking latch assembly for an automotive endgate, comprising:

a handle pivotally mounted to a mounting bracket wherein said mounting bracket is supported by said endgate;

a latch arm pivotally coupled to said handle, said latch arm including a slide surface, said latch arm rotating about a primary pivot pin displacing a drive pin with said slide surface;

a slotted drive arm pivotally coupled to said primary pivot pin, said drive arm being rotatably driven by said drive pin, said drive arm including a slave pin for driving a pivotally mounted slave arm and a first cable coupling for retracting a first cable, said slave arm further including a second cable coupling for retracting a second cable;

a locking arm receiving said drive pin, said locking arm including a stop finger for impeding rotation of said latch arm in a first mode of operation and allowing said latch arm to rotate in a second mode of operation; and a lock assembly supporting said endgate for rotating said slotted locking arm and said stop finger into said first mode and said second mode of operation.

2. The locking latch assembly of claim 1, wherein said endgate is substantially metal.

3. The locking latch assembly of claim 1, wherein said endgate is substantially a plastic composite.

4. The locking latch assembly of claim 1, further comprising a shield mounted to said endgate and said locking latch assembly which substantially covers said locking latch assembly.

5. The locking latch assembly of claim 1, wherein said handle is further configured with a cammed surface.

6. The locking latch assembly of claim 1, wherein said locking arm is pivotally mounted and is configured with a slot for receiving said drive pin.

* * * * *